United States Patent [19]

Benoit et al.

[11] 4,033,639

[45] July 5, 1977

[54] DRAWER SLIDE

[75] Inventors: Roland A. Benoit; Richard H. Duprey, both of Danielson, Conn.

[73] Assignee: Interroyal Corporation, New York, N.Y.

[22] Filed: Oct. 20, 1975

[21] Appl. No.: 624,200

[52] U.S. Cl. ..... 308/3.6

[51] Int. Cl.[2] ..... F16C 21/00

[58] Field of Search ..... 308/3.6, 3 R

[56] References Cited

UNITED STATES PATENTS

| | | | |
|---|---|---|---|
| 1,422,142 | 7/1922 | Smith | 308/3.6 |
| 2,679,447 | 5/1954 | Bissman | 308/3.6 |
| 3,462,203 | 8/1969 | Vecchio | 308/3.6 |

*Primary Examiner*—Joseph F. Peters, Jr.
*Assistant Examiner*—Richard A. Berisch
*Attorney, Agent, or Firm*—Arthur A. March

[57] ABSTRACT

Control drawer slide for holding a drawer against unintentional removal in which the track for guiding the drawer during inward and outward movement is provided in the vicinity of its outward end with an interrupting depressed control track section having a downwardly inclined track portion in the direction of inward drawer movement, which cooperates with an offset drawer stop operatively positioned out of the path of the track and extending into the drawer path and situated at a level above the depressed track section to permit intentional downward tilting of the rear end of the drawer at the depressed track section to clear the stop yet hold the drawer upon normal outward movement against unintentional removal by otherwise abutment with the stop.

15 Claims, 6 Drawing Figures

FIG. 1
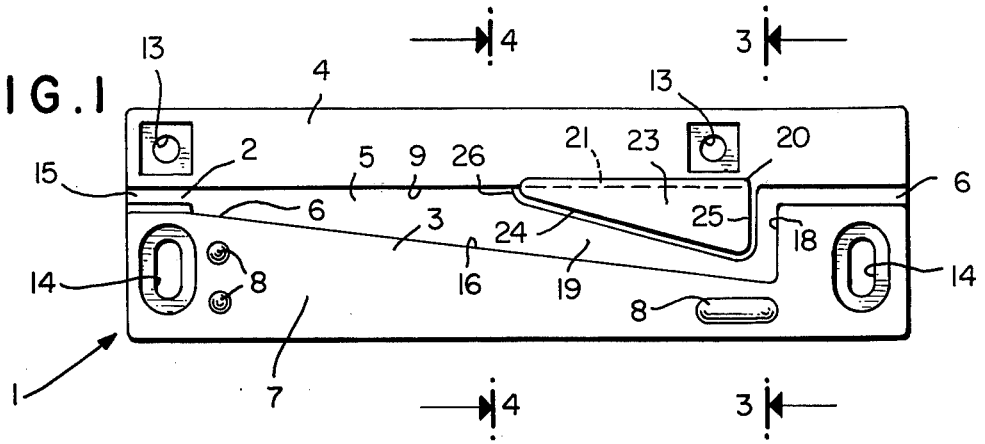
FIG. 3
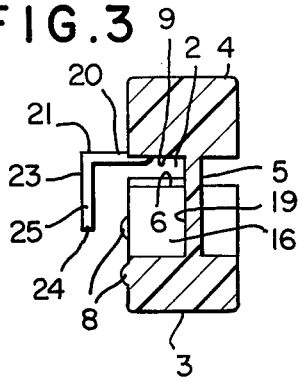
FIG. 4
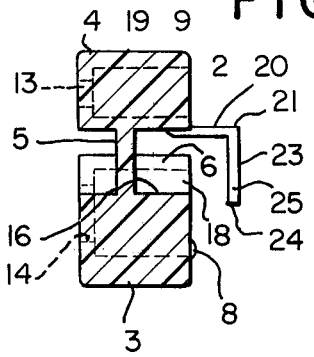
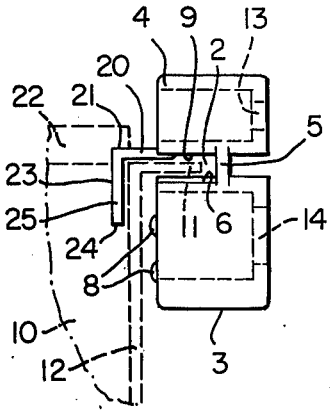
FIG. 2
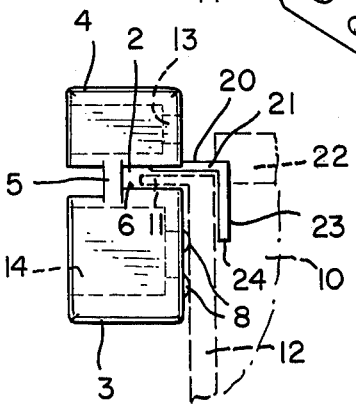
FIG. 5
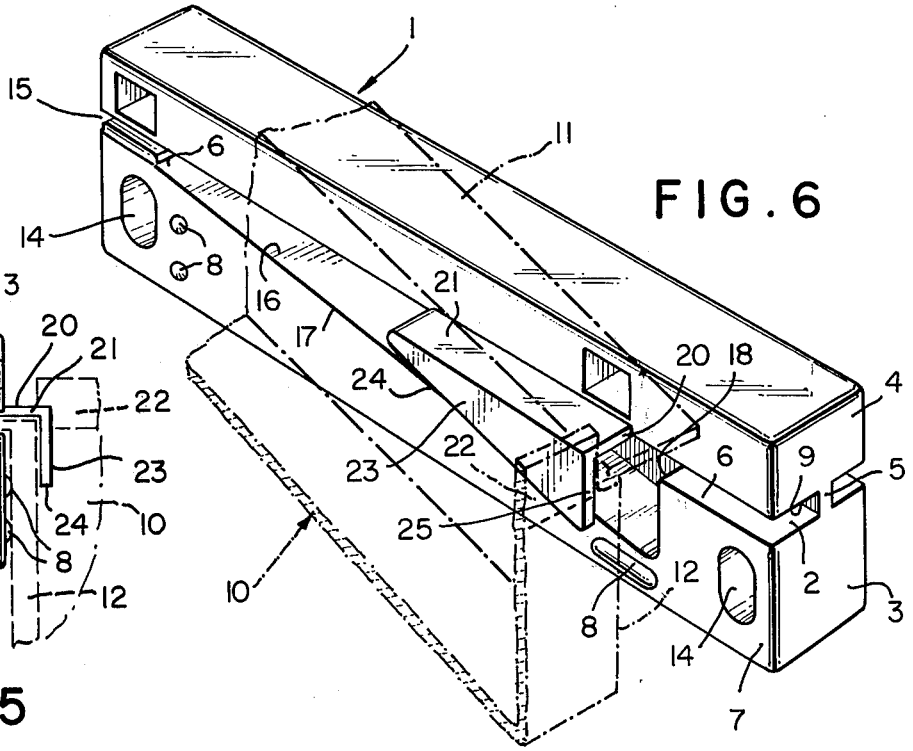
FIG. 6

DRAWER SLIDE

The present invention relates to drawer slides, and more particularly to drawer slides having means for holding drawers against unintentional removal, involving positioned cooperation between a depressed control track section of the track used for guiding the drawer and an offset drawer stop extending into the drawer path and situated at a level above the depressed track section to permit intentional tilting of the drawer to clear the stop yet otherwise hold the drawer against unintentional removal.

Many kinds of drawer slides are known. Among these are assemblies used to prevent inadvertent drawer removal. All such conventional constructions, however, suffer from one or more of a combination of disadvantages including the need for numerous relatively intricate and complicated coacting structural elements which are expensive to produce and assemble, involving economically significant time, labor and materials, and some of which are even insufficiently durable in use, lacking adequate strength and resistance to wear under the rigors of the imposed service conditions. Moreover, often the particular drawer slide assembly comtemplates extensive modifications of the drawer itself as well as of the surrounding framework of the furniture or equipment in which the drawers are to be inserted, for the drawer slide assembly to be properly accommodated both operationally and dimensionally.

There is hence a real need for a practical control drawer slide which is capable of preventing inadvertent drawer removal, yet which is simple and durable in construction, readily and inexpensively produced from many available commercially competitive materials, uncomplicated in design, compact in dimension, utilizing a minimum of coacting parts, and easily mountable in the usual furniture and equipment drawer framework without extensive modification thereof or of the drawer itself for successful long term use under rigorous service conditions.

It is an object of the present invention to overcome the foregoing disadvantages and to provide an improved drawer slide for holding drawers against unintentional removal, and having novel means providing positional coaction between cooperating parts to control drawer movement to permit drawer removal only upon executing an intentional inward tilting of the drawer to clear an offset drawer stop, without otherwise detracting from normal drawer operation, guidance or support.

It is another object of the invention to provide a control drawer slide construction which includes a minimum of necessary coacting elements and which avoids the need for extensive drawer modification or similar modification of the surrounding framework of the furniture or equipment in which the drawer is to be inserted.

It is still another object of the invention to provide such a drawer slide which is simple and uncomplicated in construction and design, compact in dimension, readily and inexpensively produced and installed, and contemplating a wide range of readily available commercially economical starting materials which permit manufacture of durable, strong and wear-resistant structural products of the instant type conveniently able to withstand the rigors of imposed service conditions over extended durations of active use due to the nature and mechanical integrity of the design features of the cooperating parts.

Other and further objects of the invention will become apparent from a study of the within specification and accompanying drawings, in which:

FIG. 1 is a schematic side elevation of the drawer slide according to an embodiment of the invention as seen from the space adjacent thereto in which the drawer is inserted;

FIG. 2 is a schematic rear view of the drawer slide of FIG. 1 illustrating in phantom the positional relation between the drawer side wall flange and drawer slide track and between the drawer rear wall blocking portion and the offset stop;

FIG. 3 is a schematic sectional view taken along the line 3—3 of FIG. 1 showing the disposition of the downwardly inclined track portion;

FIG. 4 is a schematic sectional view taken along the line 4—4 of FIG. 1 showing the disposition of the upwardly extending transition track portion registering with the track inwardly therebeyond;

FIG. 5 is a schematic front view of the drawer slide of FIG. 1 illustrating the entrance of the slot and in phantom the positional relation between the drawer slide parts and drawer parts in reverse of that shown in FIG. 2; and FIG. 6 is a schematic perspective view of the drawer slide of the invention illustrating in phantom the manner in which the drawer is tilted in the vicinity of the outward end of the drawer slide to clear the stop.

Briefly, the present invention contemplates a drawer slide, preferably in the form of a one-piece integral composite assembly, for holding a drawer against unintentional removal, having means providing positional coaction between cooperating parts to control drawer movement to permit drawer removal only upon executing an intentional inward tilting of the drawer to clear an offset drawer stop, without otherwise detracting from normal drawer operation, guidance and support.

According to the present invention, the drawer slide for holding a drawer against unintentional removal generally comprises a track for guiding the drawer during normal inward and outward movement, the track being interrupted in the vicinity of its outward end by a depressed track section having a downwardly inclined track portion in the direction of inward drawer movement, and a cooperating offset drawer stop operatively positioned out of the path of the track and extending into the normal path of the drawer and situated at a level above the depressed track section. By locating the stop at a sufficient level above the depressed track section, the drawer is permitted upon inward and outward movement to be intentionally correspondingly downwardly tilted at the depressed track section to clear the stop yet the drawer is held against unintentional removal upon normal outward movement by abutment with the stop.

The stop may include an abutment portion which extends laterally from a point overlying the track into the path of the drawer. Also, the stop may include an abutment portion which extends downwardly from a point above the track into the path of the drawer and which terminates at a level above the depressed track section sufficient for negotiating the foregoing clearance tilting movement.

The downwardly inclined track portion desirably terminates inwardly of the stop at an upwardly extending transitional track portion which registers with the track inwardly therebeyond. In turn, the stop desirably includes a corresponding downwardly inclined lower guide edge extending along the depressed track section and terminating at a level above the downwardly inclined track portion. This merges with a corresponding upwardly extending transitional abutment edge along and spaced outwardly from the transitional track portion.

Thus, as the drawer is inserted and moves inwardly along the track, it may be readily tilted or tipped inwardly and downwardly to ride along the drawer slide downwardly inclined track portion via its corresponding drawer side wall flange and be correspondingly guided along the lower guide edge of the stop via a portion of its drawer rear wall. When the drawer side wall flange reaches the upwardly extending transitional track portion, the stop-engaging or blocking portion of the drawer rear wall will have passed under the stop due to the clearance provided by the positional relation of the depressed track section and the stop at a sufficient level thereabove, and in turn the drawer side wall flange will have abutted and been guided upwardly along the transitional track portion back to the normal level of the track.

In removing the drawer intentionally, the reverse sequence occurs. As the drawer moves outwardly along the track, the stop-engaging or blocking portion of the drawer rear wall will abut the stop, and upon corresponding tilting or tipping, the drawer rear wall blocking portion will be guided downwardly along the transitional abutment edge to clear the underside of the stop and thence outwardly and upwardly along the inclined track portion to the track entrance.

Referring to the drawings, a drawer slide 1 according to one embodiment of the invention is shown, which is preferably made as an integrally connected, one-piece compact structure from plastic material, optionally containing structurally reinforcing filler materials or the like. The unit can also be produced from wood, metal or the like by conventional techniques. It is intended for mounting in the front of the framework at the entrance of the drawer thereinto.

Regarding general aspects of the unit, a unilaterally open longitudinal slot 2 is defined in drawer slide 1 by the adjacency of the lower longitudinal member 3, the upper longitudinal member 4 and the intermediate upstanding longitudinal wall 5 interconnecting members 3 and 4 in spaced superimposed relation. Lower member 3 is provided with a normal longitudinal track 6 along its top surface and a laterally confining slide face 7 along its side surface adjacent the slot opening. Slide face 7 is provided with guide pads 8 slightly raised from the surface thereof to minimize friction and binding as the corresponding drawer slide wall and/or flange thereat moves inwardly and outwardly thereagainst. Upper member 4 has a cooperating upper confining longitudinal wall 9 along its underside in overlying relation to track 6.

As shown in phantom in FIGS. 2, 5 and 6, the normal drawer flange 11 of drawer 10 is slidably received, guided and supported in slot 2 as the corresponding side wall 12 of the drawer travels along slide face 7 and over guide pads 8. This type of drawer is provided with the usual slide flanges, i.e., along the upper portion of the corresponding side walls of the drawer, normally as simple laterally outward extensions therefrom, although other configurations of drawer side flanges are contemplated, so long as the flange laterally outwardly extends in some manner permitting it to operatively engage track 6 for the intended purposes.

Of course, while the present invention is illustrated in terms of single drawer slide 1, preferably an opposing mirror-image drawer slide (not shown) will be provided for the other lateral side of the drawer in question, whose function and operation will be the same as that for drawer slide 1. It will be appreciated that such versatile applicability of the invention on a bilateral basis may readily be modified to accommodate drawer and drawer framework modifications by utilizing but one drawer slide unit of the invention, i.e., on a unilateral basis, e.g. merely with a simple negotiating depressed track section in that drawer slide for the opposing drawer flange of the drawer (not shown) in the drawer slide range where the required tilting of the drawer is to take place.

While the normal track 6 is shown of minimum necessary length, drawer slide 1 may be rearwardly extended in length as desired, depending on the longitudinal dimension of the drawer and its intended service load, or conventional slide means may be provided in the framework for receiving the drawer 1 positioned in tandem alignment inwardly behind the drawer slide of the invention. The drawer slide 1, for example when provided as a simple and inexpensive plastic molded one-piece unit, may be readily mounted in the interior of the framework by the provision for recessed screw holes 13 in upper member 4 and cooperating recessed adjustment slits 14 in lower member 3.

With respect to the particular spatial relationship and coacting parts which embody the main features of the invention, it will be seen that track 6 is interrupted in the vicinity of the outward end or entrance 15 of slot 2 by a depressed track section 16, having a downwardly inclined track portion 17 in the direction of inward drawer movement inwardly terminating at an upwardly and inwardly limiting transitional track portion 18 which in turn registers or merges with the remainder of track 6 inwardly therebeyond. As aforesaid, this remainder of thus interrupted track 6 may be of any desired length depending upon the dimensions and service load chosen for the drawer in question. Depressed track section 16, by reason of its configuration with respect to the adjacent disposition of lower member 3, upper member 4 and upstanding wall 5, forms with such wall 5 and the overlying upper confining wall 9 a corresponding inwardly diverging more or less vertical slot space 19 therebetween for accommodating the corresponding drawer side wall flange 11 in any position of its controlled tilting movement inwardly or outwardly along this interrupted region of track 6.

A cooperating offset drawer stop 20 is disposed adjacent to depressed track section 16, these elements essentially comprising the control means of the drawer slide of the invention for permitting intentional drawer removal while preventing unintentional or inadvertent drawer removal. Stop 20 is operatively positioned out of the normal path of track 6 including depressed track section 16 yet extends or projects operatively into the path of the drawer 10. Stop 20 is situated at a level sufficiently above the depressed track section 16 to permit the drawer upon inward and outward movement to be intentionally correspondingly downwardly tilted or tipped at the depressed track section (see FIG. 6) to clear stop 20 yet hold the drawer upon normal outward movement against unintentional removal by otherwise abutment with stop 20.

For this purpose, stop 20 is provided with an overlying lateral spacing bridge abutment portion 21 interconnecting the stop and upper confining wall 9 at upper member 4, and thus extending laterally from a point overlying track 6 in the region of depressed track section 16 to a point laterally spaced from the track sufficiently to accommodate operatively thereunder the corresponding side wall 12 of the drawer 10 during normal inward and outward movement therealong (see FIGS. 2 and 5). By the provision for an upwardly projecting wing or a portion of the drawer rear wall itself in the region of that corresponding side of the drawer, designated by blocking portion or part 22, disposed in the path of stop 20 during normal drawer movement, the drawer will abut the rearwardly facing edge of bridge abutment portion 21 and be held against unintentional removal. Only upon tilting of the drawer as described will the part 22 be able to clear the underside of stop 20 for intentional drawer removal, and of course for drawer insertion as well.

In order to accommodate both those drawers having such part 22 as well as those in which no upwardly projecting wing is present or in which the drawer rear wall in that region of the corresponding side of the drawer does not extend upwardly beyond the upper portion of the drawer side wall, so as to form such part 22, the stop 20 may be provided with a downwardly extending or depending guide abutment portion 23 projecting into the normal drawer path thereat and situated at a level sufficiently above the depressed track section 16 for the necessary control and clearance to be achieved. In the embodiment shown, stop 20 includes such depending guide abutment portion 23 in the form of an extension from the free end of bridge abutment portion 21 which correspondingly terminates at a level above the depressed track section 16. Bridge abutment portion 21 thus serves in this embodiment, together with upper confining wall 9 of upper member 4 and upstanding wall 5, as interconnecting means to connect, preferably integrally, track 6 with guide abutment portion 23 forming stop 20.

Guide abutment portion 23 is provided optionally as a more or less triangular shaped part roughly following the angular orientation of the downward and inward boundaries of inclined track portion 17 and transitional track portion 18 which in essence form the more or less vertical triangular expanse of slot space 19 with upper confining wall 9. Guide abutment portion 23 preferably includes a corresponding downwardly inclined lower guide edge 24 extending along the depressed track section 16 in the region of the lowermost extent of inclined track portion 17 and terminating at a level spaced above such inclined track portion 17 sufficiently to permit clearance therebetween of the adjacent portion of the drawer during the tilting manipulation. Lower guide edge 24 desirably merges with the corresponding upwardly extending transitional abutment edge 25 of stop 20 thereat. Stop 20 is so dimensioned with respect to depressed track section 16 that transitional abutment edge 25 extends along yet is outwardly spaced from transitional track portion 18 sufficiently to permit enough clearance thereat to permit the normally blocked portion of the drawer, e.g., part 22 or the upper portion of the rear wall of a drawer having side walls and a rear wall of the same height, to negotiate the tilting manipulation guide path downwardly between abutment edge 25 and track portion 18 and under and along the gap between guide edge 24 and inclined track portion 17, for intentional drawer removal and reverse operation for drawer insertion.

In the latter instance, advantageously, optional guide edge 24 serves to facilitate inward and downward tilting travel of the rear end portion of the drawer being inserted into the framework by sliding contact with the top edge portion of the drawer which is normally blocked by stop 20, while abutment between the rearmost portion of the corresponding drawer flange thereat with transitional track portion 18 signals inward completion of the stop clearance operation, enabling the drawer to be returned to its normal more or less horizontal level as drawer flange 11 rises within slot space 19 to the upwardly confining limit of upper wall 9 for further movement along the remainder of track 6 inwardly therebeyond.

Thus, the spacing of stop 20 with respect to track 6 at interrupting depressed track section 16 must be sufficient merely to provide corresponding dimensional operative clearance more or less vertically both between guide edge 24 and inclined track portion 17 and between transitional abutment edge 25 and transitional track portion 18, and more or less laterally or horizontally between track 6 at depressed track section 16 and stop 20, e.g., at bridge abutment portion 21 and/or transitional abutment edge 25, to permit the drawer upon inward and outward movement to be intentionally correspondingly downwardly tilted at the depressed track section 16 and the drawer flange 11 to descend into the diverging slot space 19 and the normally blocked drawer rear wall portion, or part 22, to clear stop 20, yet hold the drawer upon normal outward movement against unintentional removal by otherwise abutment of the normally blocked drawer rear wall portion, or part 22, with stop 20.

Where the drawer slide unit is manufactured from plastic material by molding techniques, as is often preferred because of the attendant economy and production versatility, an aperture 26 will normally occur in upstanding wall 5 to facilitate formation of the offset stop 20 as part of the one-piece integrally molded composite unit. To converse construction material without sacrificing needed strength, the reverse sides of members 3 and 4 may also be formed with hollowed out indentations in the conventional manner. This will add to the lightweight qualities of the produced drawer slides and enable them to be easily manually manipulated during installation in the framework of the furniture or other equipment in which the drawer is to be received.

It will be seen, therefore, that the present invention provides a drawer slide of the stated type having novel means providing positional coaction between cooperating parts to control drawer movement to permit drawer removal only upon executing an intentional inward tilting of the drawer at the entry into the framework to clear the offset drawer stop thereat, without otherwise detracting from normal drawer operation, guidance or support. A minimum of necessary coacting elements is utilized, and extensive drawer modification or similar modification of the surrounding framework for the drawer is avoided. The unit is simple and uncomplicated in construction and design, compact in dimension, readily and inexpensively produced and installed, and can be made as a durable, strong and wear-resistant structure by selective employment of readily available starting materials. The nature and mechanical integrity of the design features of the cooperating parts enhance the chances of the overall unit to withstand the normal rigors of imposed service conditions over extended durations of active use.

It will be appreciated that stop 20, although offset with respect to track 6, need only include a laterally projecting portion at a level overlying the track, e.g., of the type contemplated by bridge abutment portion 21, and thus just sufficiently high, to clear the drawer flange and/or drawer side wall passing along thereunder, where the drawer in question contains a blocking portion, e.g., part 22, normally disposed in the path of the stop and of increased height above the level of the drawer flange 11 and track 6. Alternatively, stop 20 need only include a downwardly projecting portion, e.g., of the type contemplated by transitional abstract edge 25, where the drawer in question does not contain such higher level blocking portion but instead contains side and rear walls more or less of the same height whereupon the appropriate upper edge portion of the rear wall of the drawer will normally be disposed in the path of the stop at the level of the drawer flange and track and thus serve as the drawer blocking portion. Nevertheless, by providing a stop configuration having both types of stopping, as shown in the drawing, drawers of all such kinds can be accommodated by such drawer slide unit of the invention. As used herein, the offset stop and corresponding blocking or blocked portion of the drawer are intended to embrace the foregoing travel path orientation and positional relation concept of coating and blocking as described variously throughout the specification.

Although the unit has been described primarily in terms of horizontal and vertical orientation of parts, it will be appreciated that any appropriate orientation is contemplated which will otherwise permit drawer operation. In addition, the inward direction or movement as described is intended to cover the relative longitudinal direction of travel of the rear end of the drawer from the framework entrance inwardly and rearwardly to the rear of the framework to close the drawer, while the outward direction or movement as described is intended to cover the opposite relative longitudinal direction of travel of the drawer rear end from the framework rear outwardly and forwardly to the framework entrance to open the drawer, with the tilting direction always referring to the downward and inward incline along track portion 17 whether the drawer is intentionally being inserted or removed.

It will be appreciated that the foregoing specification and drawings have been set forth by way of illustration and not limitation, and that various modifications and changes may be made therein without departing from the spirit and scope of the present invention which is to be limited solely by the scope of the appended claims.

What is claimed is:

1. Drawer slide for holding a draw against unintentional removal comprising:

a track for guiding the drawer during inward and outward movement, said track being interrupted in the vicinity of its outward end by a depressed track section having a downwardly inclined track portion in the direction of inward drawer movement, and a cooperating offset drawer stop operatively positioned out of the path of the track and extending into the path of the drawer and situated at a level sufficiently above the depressed track section to permit the drawer upon inward and outward movement to be intentionally correspondingly downwardly tilted at said depressed track section to clear said stop yet hold the drawer upon normal outward movement against unintentional removal by otherwise abutment with said stop.

2. Drawer slide according to claim 1 wherein said stop includes an abutment portion stationarily extending laterally from a point overlying said track into the path of the drawer.

3. Drawer slide according to claim 1 wherein said stop includes an abutment portion stationarily extending downwardly from a point above said track into the path of the drawer and terminating at a level above the depressed track section.

4. Drawer slide according to claim 1 wherein said downwardly inclined track portion terminates inwardly of said stop at an upwardly extending transitional track portion registering with the track inwardly therebeyond.

5. Drawer slide according to claim 4 wherein said stop includes a corresponding downwardly inclined lower guide edge extending along the depressed track section and terminating at a level above the downwardly inclined track portion and merging with a corresponding upwardly extending transitional abutment edge along and spaced outwardly from said transitional track portion.

6. Drawer slide according to claim 1 wherein interconnecting means are provided to connect integrally said track and said stop.

7. Drawer slide for holding a drawer against unintentional removal comprising:

a longitudinal track for guiding the drawer during inward and outward movement, said track being interrupted in the vicinity of its outward end by a depressed track section having a downwardly inclined track portion in the direction of inward drawer movement inwardly terminating at an upwardly extending and inwardly limiting transitional track portion registering with the longitudinal track inwardly therebeyond, and a cooperating offset drawer stop adjacent to the depressed track section and operatively positioned out of the path of the track and extending into the path of the drawer, and including a bridge abutment portion extending laterally from a point overlying the track to a point laterally spaced from the track and a depending guide abutment portion extending downwardly from said bridge abutment portion to a level above the depressed track section, said guide abutment portion including a corresponding downwardly inclined lower guide edge extending along the depressed track section and terminating at a level spaced above the downwardly inclined track portion and merging with a corresponding upwardly extending transitional abutment edge along and spaced outwardly from said transitional track portion, the spacing of said stop with respect to said track and depressed track section being sufficient to provide corresponding dimensional operative clearance between said guide edge and said inclined track portion and between said transitional abutment edge and said transitional track portion and laterally between said track and said stop to permit the drawer upon inward and outward movement to be intentionally correspondingly downwardly tilted at said depressed track section to clear said stop yet hold the drawer upon normal outward movement against unintentional removal by otherwise abutment with said stop.

8. Drawer slide for holding a drawer against unintentional removal comprising:

means defining a unilaterally open longitudinal slot including a lower longitudinal track and a cooperating upper confining longitudinal wall overlying said track for guiding a drawer flange provided along the upper portion of the corresponding side wall of the drawer during inward and outward movement, said track being interrupted in the vicinity of the outward end of the slot by a depressed track section having a downwardly inclined track portion in the direction of inward drawer movement and forming with said upper confining wall a corresponding inwardly diverging slot space therebetween, and a cooperating offset drawer stop adjacent to the depressed track section and operatively positioned out of the path of the track and extending into the path of a portion of the rear wall of the drawer and situated at a level sufficiently above the depressed track section to permit the drawer upon inward and outward movement to be intentionally correspondingly downwardly tilted at said depressed track section and said drawer flange to descend into said diverging slot space and the drawer rear wall portion to clear said stop yet hold the drawer upon normal outward movement against unintentional removal by otherwise abutment of said drawer rear wall portion with said stop.

9. Drawer slide according to claim 8 wherein said stop includes an abutment portion extending laterally from said upper confining wall overlying said track into the path of the drawer rear wall portion.

10. Drawer slide according to claim 8 wherein said stop includes an abutment portion extending downwardly from said upper confining wall overlying said track into the path of the drawer rear wall portion.

11. Drawer slide according to claim 8 wherein said downwardly inclined track portion terminates inwardly of said stop at an upwardly extending transitional track portion registering with the track inwardly therebeyond.

12. Drawer slide according to claim 11 wherein said stop includes a corresponding downwardly inclined lower guide edge extending along the depressed track section and terminating at a level above the downwardly inclined track portion and merging with a corresponding upwardly extending transitional abutment edge along and spaced outwardly from said transitional track portion.

13. Drawer according to claim 12 wherein said stop is laterally spaced from said track sufficiently to accommodate operatively therebetween the corresponding side wall of the drawer during inward and outward movement.

14. Drawer slide according to claim 13 wherein said stop includes an overlying lateral spacing bridge abutment portion interconnecting said stop and said upper confining wall.

15. One-piece drawer slide for holding a drawer against unintentional removal comprising:

means defining a unilaterally open longitudinal slot including a lower longitudinal member, an upper longitudinal member and an upstanding longitudinal wall interconnecting said members in spaced superimposed relation, said lower member having a longitudinal track along its top surface and a laterally confining slide face along the side surface thereof adjacent the slot opening and said upper member having a cooperating upper confining longitudinal wall along its underside overlying said track, for guiding a drawer flange provided along the upper portion of the corresponding side wall of the drawer in the slot and the drawer side wall along said slide face during inward and outward movement, said track being interrupted in the vicinity of the outward end of the slot by a depressed track section having a downwardly inclined track portion in the direction of inward drawer movement inwardly terminating at an upwardly and inwardly limiting transitional track portion registering with the longitudinal track inwardly therebeyond and forming with said upstanding wall and said upper confining wall a corresponding inwardly diverging slot space therebetween, and a cooperating offset drawer stop adjacent to the depressed track section and operatively positioned out of the path of the track and extending into the path of a portion of the rear wall of the drawer and situated at a level above the depressed track section, and including an overlying lateral spacing bridge abutment portion interconnecting said stop and said upper confining wall and extending laterally from a point overlying the track to a point laterally spaced from the track sufficiently to accommodate operatively thereunder the corresponding side wall of the drawer during inward and outward movement and a depending guide abutment portion extending from said bridge abutment portion to a level above the depressed track section, said guide abutment portion including a corresponding downwardly inclined lower guide edge extending along the depressed track section and terminating at a level spaced above the downwardly inclined track portion and merging with a corresponding upwardly extending transitional abutment edge along and spaced outwardly from said transitional track portion, the spacing of said stop with respect to said track and depressed track section being sufficient to provide corresponding dimensional operative clearance between said guide edge and said inclined track portion and between said transitional abutment edge and said transitional track portion and laterally between said track and said stop to permit the drawer upon inward and outward movement to be intentionally correspondingly downwardly tilted at said depressed track section and said drawer flange to descend into said diverging slot space and the drawer rear wall portion to clear said stop and yet hold the drawer upon normal outward movement against unintentional removal by otherwise abutment of said drawer rear wall portion with said stop.

* * * * *